US012808072B2

(12) United States Patent
Tamura

(10) Patent No.: US 12,808,072 B2
(45) **Date of Patent: *Nov. 24, 2026**

(54) WATER ELECTROLYSIS SYSTEM

(71) Applicant: HONDA MOTOR CO., LTD., Tokyo (JP)

(72) Inventor: Koki Tamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 456 days.

This patent is subject to a terminal disclaimer.

(21) Appl. No.: 18/382,760

(22) Filed: Oct. 23, 2023

(65) Prior Publication Data

US 2024/0141523 A1 May 2, 2024

(30) Foreign Application Priority Data

Oct. 26, 2022 (JP) ..... 2022-171062

(51) Int. Cl.

| | |
|---|---|
| ***C25B 15/027*** | (2021.01) |
| ***C25B 1/04*** | (2021.01) |
| ***C25B 9/70*** | (2021.01) |
| ***C25B 15/08*** | (2006.01) |

(52) U.S. Cl.

CPC ..... *C25B 15/027* (2021.01); *C25B 1/04* (2013.01); *C25B 9/70* (2021.01); *C25B 15/087* (2021.01)

(58) Field of Classification Search

None

See application file for complete search history.

(56) References Cited

U.S. PATENT DOCUMENTS

| | | | | |
|---|---|---|---|---|
| 12,037,692 | B2 * | 7/2024 | Kawano | C25B 1/02 |
| 2019/0363386 | A1 | 11/2019 | Wakita et al. | |
| 2019/0368483 | A1 | 12/2019 | Wakita et al. | |
| 2020/0340457 | A1 | 10/2020 | Ukai et al. | |
| 2020/0343567 | A1 | 10/2020 | Wakita et al. | |
| 2022/0042192 | A1 | 2/2022 | Mitsuta | |

(Continued)

FOREIGN PATENT DOCUMENTS

| | | | |
|---|---|---|---|
| CN | 110528012 | A | 12/2019 |
| CN | 110552016 | A | 12/2019 |
| CN | 111742082 | A | 10/2020 |

(Continued)

OTHER PUBLICATIONS

Office Action dated Aug. 6, 2024 issued in the corresponding Japanese Patent Application 2022-171062 with the English machine translation thereof.

(Continued)

*Primary Examiner* — Luan V Van

(74) *Attorney, Agent, or Firm* — Carrier, Shende & Associates P.C.; Joseph P. Carrier; Jeffrey T. Gedeon

(57) ABSTRACT

A water electrolysis system includes a water electrolysis stack, a gas-liquid separator, a hydrogen pressure boosting stack, a first power supply device, a second power supply device, and a control device. The control device acquires an electric resistance value of the second power supply device that applies a predetermined voltage to an anode and a cathode of the hydrogen pressure boosting stack, and controls a value of a current to be applied to the water electrolysis stack, based on the electric resistance value and the temperature of water in the gas-liquid separator.

3 Claims, 3 Drawing Sheets

(56) References Cited

U.S. PATENT DOCUMENTS

2023/0279558 A1 9/2023 Kawano

FOREIGN PATENT DOCUMENTS

| | | | | |
|---|---|---|---|---|
| CN | 215757657 | U | * | 2/2022 |
| JP | 2003105578 | A | * | 4/2003 |
| JP | 2004-172105 | A | | 6/2004 |
| JP | 2015034316 | A | * | 2/2015 |
| JP | 2019-210205 | A | | 12/2019 |
| JP | 2022-029892 | A | | 2/2022 |
| JP | 2023-128165 | A | | 9/2023 |
| WO | 2020/095543 | A1 | | 5/2020 |

OTHER PUBLICATIONS

Office Action and Search Report dated Sep. 30, 2026, issued in the corresponding Chinese Patent Application No. 202311389934.4 with the English machine translation thereof.

* cited by examiner

WATER ELECTROLYSIS SYSTEM

CROSS-REFERENCE TO RELATED APPLICATIONS

This application is based upon and claims the benefit of priority from Japanese Patent Application No. 2022-171062 filed on Oct. 26, 2022, the contents of which are incorporated herein by reference.

BACKGROUND OF THE INVENTION

Field of the Invention

The present invention relates to a water electrolysis system.

Description of the Related Art

In recent years, research and development have been conducted on fuel cells that contribute to energy efficiency in order to ensure access of more people to affordable, reliable, sustainable and modern energy. Further, in order to reduce the load on the environment, exhaust gas regulations on moving bodies such as automobiles having internal combustion engines have been further advanced. Therefore, attempts have been made to mount a fuel cell in place of an internal combustion engine in a moving body. Since $CO_2$, $SO_x$, $NO_x$, and the like are not discharged from the moving body on which the fuel cells are mounted, the load on the environment is reduced.

The fuel cell generates electricity by an electrochemical reaction between hydrogen gas and oxygen gas. A system for generating hydrogen gas is disclosed in, for example, JP 2022-029892 A. The system disclosed in JP 2022-029892 A is provided with a water electrolysis stack (water electrolysis device), a gas-liquid separator (water removal unit), and a hydrogen pressure boosting stack (hydrogen gas pressure boosting unit).

The water electrolysis stack electrolyzes water to generate hydrogen gas and oxygen gas having a higher pressure than the hydrogen gas. The gas-liquid separator separates hydrogen gas and water supplied from the water electrolysis stack. The hydrogen pressure boosting stack boosts the pressure of the hydrogen gas separated by the gas-liquid separator. The water separated by the gas-liquid separator is supplied to the water electrolysis stack via the water supply unit.

SUMMARY OF THE INVENTION

There is a case where the water supply unit of JP 2022-029892 A is removed and water is directly supplied from the gas-liquid separator to the water electrolysis stack. In this case, water is supplied from the outside to replenish the water stored in the gas-liquid separator. However, the dew point temperature of the gas-liquid separator may be lowered by water supplied from the outside. When the dew point temperature of the gas-liquid separator decreases, the amount of water vapor supplied from the gas-liquid separator to the hydrogen pressure boosting stack together with the hydrogen gas decreases. As a result, there is concern that the electrolyte membrane provided in the hydrogen pressure boosting stack may be dried and thereby deteriorated.

An object of the present invention is to solve the aforementioned problem.

According to an aspect of the present invention, there is provided a water electrolysis system including: a water electrolysis stack including a membrane electrode assembly in which an electrolyte membrane is held between an anode and a cathode, the water electrolysis stack being configured to electrolyze water; a gas-liquid separator configured to separate the water and hydrogen gas generated by electrolysis of the water by the water electrolysis stack; and a hydrogen pressure boosting stack including a membrane electrode assembly in which an electrolyte membrane is held between an anode and a cathode, the hydrogen pressure boosting stack being configured to boost a pressure of the hydrogen gas separated by the gas-liquid separator, wherein the water electrolysis system further includes: a first power supply device configured to apply a voltage to the anode and the cathode of the water electrolysis stack to cause a current to flow between the anode and the cathode of the water electrolysis stack; a second power supply device configured to apply a voltage to the anode and the cathode of the hydrogen pressure boosting stack to cause a current to flow between the anode and the cathode of the hydrogen pressure boosting stack; a temperature sensor configured to detect a temperature of the water in the gas-liquid separator; and a control device configured to acquire an electric resistance value of the second power supply device that applies a predetermined voltage to the anode and the cathode of the hydrogen pressure boosting stack, and to control a value of a current to be applied to the water electrolysis stack, based on the electric resistance value and the temperature.

According to the above aspect, it is possible to accurately determine whether or not the electrolyte membrane of the hydrogen pressure boosting stack is dry, and to adjust the amount of water vapor supplied from the gas-liquid separator to the hydrogen pressure boosting stack together with hydrogen gas. As a result, deterioration of the electrolyte membrane of the hydrogen pressure boosting stack due to drying can be reduced.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

Figure 1:
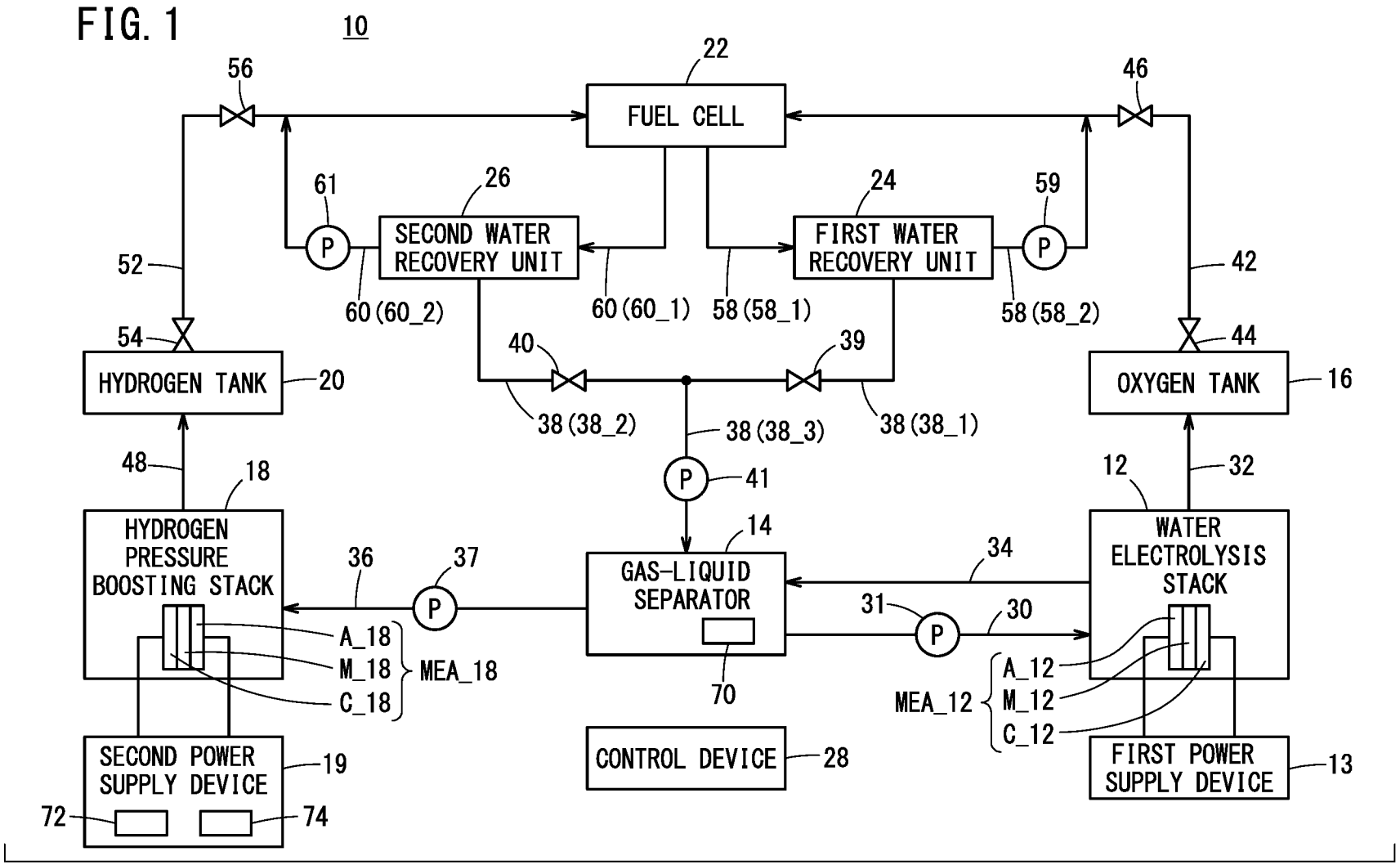
FIG. 1 is a schematic diagram illustrating a water electrolysis system according to an embodiment.

FIG. 1 is a schematic diagram illustrating a water electrolysis system 10. The water electrolysis system 10 includes a water electrolysis stack 12, a first power supply device 13, a gas-liquid separator 14, an oxygen tank 16, a hydrogen pressure boosting stack 18, a second power supply device 19, a hydrogen tank 20, a fuel cell 22, a first water recovery unit 24, a second water recovery unit 26, and a control device 28.

The water electrolysis stack 12 is a differential pressure water electrolysis stack that generates hydrogen gas and oxygen gas having a pressure higher than the pressure of the hydrogen gas, by water electrolysis. Water for water electrolysis is supplied from the gas-liquid separator 14 to the water electrolysis stack 12 via a water supply path 30. The water supply path 30 allows the gas-liquid separator 14 and the water electrolysis stack 12 to communicate with each other. The water supply path 30 is provided with a pump 31. ON/OFF of the pump 31 is controlled by the control device 28. When the pump 31 is turned on, the pump 31 applies a flow force to the water stored in the gas-liquid separator 14 and supplies the water from the gas-liquid separator 14 to the water electrolysis stack 12.

The water electrolysis stack 12 includes one or more unit cells. The unit cell includes a membrane electrode assembly MEA_12 in which an electrolyte membrane M_12 is held between an anode A_12 and a cathode C_12. The water electrolysis stack 12 supplies the water supplied from the gas-liquid separator 14 to the cathode C_12 of the unit cell. The unit cell performs water electrolysis based on a voltage applied to the anode A_12 and the cathode C_12. In this case, pressure-boosted oxygen gas is generated at the anode A_12, and pressure-boosted hydrogen gas is generated at the cathode C_12. The oxygen gas generated at the anode A_12 is at a higher pressure than the hydrogen gas generated at the cathode C_12. The pressure of the oxygen gas is increased by, for example, a throttle valve or the like provided in an oxygen discharge path 32.

The oxygen gas generated in the unit cell of the water electrolysis stack 12 is stored in the oxygen tank 16 via the oxygen discharge path 32. The oxygen discharge path 32 is a conduit for discharging oxygen gas from the water electrolysis stack 12 to the oxygen tank 16, and allows the water electrolysis stack 12 to communicate with the oxygen tank 16.

A discharge fluid containing hydrogen gas and unreacted water generated in the unit cells of the water electrolysis stack 12 is supplied to the gas-liquid separator 14 via a water discharge path 34. The water discharge path 34 is a conduit for discharging the discharge fluid from the water electrolysis stack 12 to the gas-liquid separator 14, and allows the water electrolysis stack 12 to communicate with the gas-liquid separator 14.

The first power supply device 13 applies a voltage to the anode A_12 and the cathode C_12 to cause a current to flow between the anode A_12 and the cathode C_12. The first power supply device 13 is configured to be able to change a current value of a current flowing between the anode A_12 and the cathode C_12. The current value is controlled by the control device 28.

The gas-liquid separator 14 separates the discharge fluid discharged from the water electrolysis stack 12, into a gas component (hydrogen-containing gas) and a liquid component (liquid water). The hydrogen-containing gas separated by the gas-liquid separator 14 contains water vapor in addition to hydrogen gas. The hydrogen-containing gas is supplied to the hydrogen pressure boosting stack 18 via a hydrogen supply path 36. The hydrogen supply path 36 connects the gas-liquid separator 14 and the hydrogen pressure boosting stack 18. The hydrogen supply path 36 is provided with a pump 37. ON/OFF of the pump 37 is controlled by the control device 28. When being turned on, the pump 37 applies a flow force to the hydrogen gas stored in the gas-liquid separator 14 and supplies the hydrogen gas from the gas-liquid separator 14 to the hydrogen pressure boosting stack 18.

The liquid component (liquid water) separated by the gas-liquid separator 14 is temporarily stored in the gas-liquid separator 14 and is supplied again to the water electrolysis stack 12 via the water supply path 30. The water stored in the gas-liquid separator 14 includes water supplied through a feed-water path 38. The feed-water path 38 is a conduit for supplying water from the first water recovery unit 24 and the second water recovery unit 26 to the gas-liquid separator 14. The feed-water path 38 includes a first feed-water path 38_1 and a second feed-water path 38_2.

The first feed-water path 38_1 allows the first water recovery unit 24 and the gas-liquid separator 14 to communicate with each other. The second feed-water path 38_2 allows the second water recovery unit 26 and the gas-liquid separator 14 to communicate with each other. In the present embodiment, the downstream end portion of the first feed-water path 38_1 and the downstream end portion of the second feed-water path 38_2 are formed as one merging path 38_3. A first feed-water valve 39 is provided in the first feed-water path 38_1, and a second feed-water valve 40 is provided in the second feed-water path 38_2. Opening and closing of the first feed-water valve 39 and the second feed-water valve 40 is controlled by the control device 28. The merging path 38_3 is provided with a pump 41. ON/OFF of the pump 41 is controlled by the control device 28. When the pump 41 is turned on, the pump 41 applies a flow force to the water stored in the first water recovery unit 24 or the second water recovery unit 26, and supplies the water from the first water recovery unit 24 or the second water recovery unit 26 to the gas-liquid separator 14.

The oxygen tank 16 stores the oxygen gas generated by the water electrolysis of the water electrolysis stack 12. The oxygen gas stored in the oxygen tank 16 is supplied to the fuel cell 22 via an oxygen gas supply path 42. The oxygen gas supply path 42 is a conduit for supplying the oxygen gas stored in the oxygen tank 16 to the fuel cell 22, and allows the oxygen tank 16 to communicate with the fuel cell 22. The oxygen gas supply path 42 is provided with an oxygen release valve 44 and a pressure reducing valve 46. The oxygen release valve 44 is disposed near the outlet of the oxygen tank 16. The opening and closing of the oxygen release valve 44 is controlled by the control device 28. The pressure reducing valve 46 reduces the pressure of the oxygen gas stored in the oxygen tank 16. The pressure of the oxygen gas reduced by the pressure reducing valve 46 is higher than a reference pressure.

The hydrogen pressure boosting stack 18 includes an electrochemical hydrogen compressor (EHC: Electrochemical Hydrogen Compressor) that electrochemically compresses hydrogen gas. The hydrogen pressure boosting stack 18 boosts the pressure of the hydrogen gas supplied from the gas-liquid separator 14. The hydrogen gas supplied from the gas-liquid separator 14 is the hydrogen gas generated by the water electrolysis stack 12. The hydrogen gas produced by the hydrogen pressure boosting stack 18 has a higher pressure than the hydrogen gas produced by the water electrolysis stack 12.

The hydrogen pressure boosting stack 18 has one or more unit cells. The unit cell includes a membrane electrode assembly MEA_18 in which an electrolyte membrane M_18 is held between an anode A_18 and a cathode C_18. The hydrogen pressure boosting stack 18 supplies the hydrogen gas supplied from the gas-liquid separator 14, to the anode A_18 of the unit cell. The unit cell ionizes the hydrogen gas based on the voltage applied to the anode A_18 and the cathode C_18. When protons obtained by ionization of the hydrogen gas reach the cathode C_18 via the electrolyte membrane M_18, pressure-boosted hydrogen gas is generated.

The hydrogen gas generated in the unit cells of the hydrogen pressure boosting stack 18 is stored in the hydrogen tank 20 via a hydrogen discharge path 48. The hydrogen discharge path 48 is a conduit for discharging oxygen gas from the hydrogen pressure boosting stack 18 to the hydrogen tank 20, and allows the hydrogen pressure boosting stack 18 to communicate with the hydrogen tank 20.

The second power supply device 19 applies a voltage to the anode A_18 and the cathode C_18 to cause a current to flow between the anode A_18 and the cathode C_18. The second power supply device 19 is configured to be able to change a current value of a current flowing between the anode A_18 and the cathode C_18. The current value is controlled by the control device 28.

The hydrogen tank 20 stores the hydrogen gas pressure-boosted by the hydrogen pressure boosting stack 18. The hydrogen gas stored in the hydrogen tank 20 is supplied to the fuel cell 22 via a hydrogen gas supply path 52. The hydrogen gas supply path 52 is a conduit for supplying the hydrogen gas stored in the hydrogen tank 20 to the fuel cell 22, and allows the hydrogen tank 20 to communicate with the fuel cell 22. The hydrogen gas supply path 52 is provided with a hydrogen release valve 54 and a pressure reducing valve 56. The hydrogen release valve 54 is disposed near the outlet of the hydrogen tank 20. Opening and closing of the hydrogen release valve 54 is controlled by the control device 28. The pressure reducing valve 56 reduces the pressure of the hydrogen gas stored in the hydrogen tank 20. The pressure of the hydrogen gas reduced by the pressure reducing valve 56 is higher than a reference pressure.

The fuel cell 22 has a plurality of unit cells. Each unit cell includes a membrane electrode assembly in which an electrolyte membrane is held between an anode and a cathode. The fuel cell 22 supplies oxygen gas having a pressure higher than the reference pressure which is supplied from the oxygen tank 16 via the pressure reducing valve 46, to the cathode of each unit cell. The fuel cell 22 supplies hydrogen gas having a pressure higher than the reference pressure which is supplied from the hydrogen tank 20 via the pressure reducing valve 56, to the anode of each unit cell. Each unit cell generates electricity by an electrochemical reaction between oxygen gas and hydrogen gas.

The oxygen-containing gas containing unreacted oxygen gas in each unit cell of the fuel cell 22 is supplied to the oxygen gas supply path 42 via an oxygen circulation path 58. The oxygen circulation path 58 is a conduit for returning the oxygen-containing gas discharged from the fuel cell 22 to the oxygen gas supply path 42. The oxygen circulation path 58 includes an upstream portion 58_1 and a downstream portion 58_2. The upstream portion 58_1 allows the fuel cell 22 and the first water recovery unit 24 to communicate with each other. The downstream portion 58_2 allows the first water recovery unit 24 and the oxygen gas supply path 42 to communicate with each other. The oxygen circulation path 58 is provided with a pump 59. ON/OFF of the pump 59 is controlled by the control device 28. When the pump 59 is turned on, the pump 59 applies a flow force to the oxygen-containing gas discharged from the fuel cell 22 to circulate the oxygen-containing gas.

The hydrogen-containing gas containing unreacted hydrogen gas in each unit cell of the fuel cell 22 is supplied to the hydrogen gas supply path 52 via a hydrogen circulation path 60. The hydrogen circulation path 60 is a conduit for returning the hydrogen-containing gas discharged from the fuel cell 22, to the hydrogen gas supply path 52. The hydrogen circulation path 60 includes an upstream portion 60_1 and a downstream portion 60_2. The upstream portion 60_1 allows the fuel cell 22 and the second water recovery unit 26 to communicate with each other. The downstream portion 60_2 allows the second water recovery unit 26 and the hydrogen gas supply path 52 to communicate with each other. The hydrogen circulation path 60 is provided with a pump 61. ON/OFF of the pump 61 is controlled by the control device 28. When the pump 61 is turned on, the pump 61 applies a flow force to the hydrogen-containing gas discharged from the fuel cell 22 to circulate the hydrogen-containing gas.

The first water recovery unit 24 is a gas-liquid separator for recovering liquid water from the oxygen-containing gas discharged from the fuel cell 22. The liquid water is generated by an oxidation-reduction reaction between oxygen and hydrogen in the fuel cell 22. The liquid water separated by the first water recovery unit 24 is temporarily stored in the first water recovery unit 24 and then supplied to the gas-liquid separator 14. The oxygen-containing gas separated by the first water recovery unit 24 contains water vapor in addition to unreacted oxygen gas. The oxygen-containing gas is supplied to the oxygen gas supply path 42 via the downstream portion 58_2 of the oxygen circulation path 58.

The second water recovery unit 26 is a gas-liquid separator for recovering liquid water from the hydrogen-containing gas discharged from the fuel cell 22. The liquid water is generated by an oxidation-reduction reaction between oxygen and hydrogen in the fuel cell 22. The liquid water separated by the second water recovery unit 26 is temporarily stored in the second water recovery unit 26 and then supplied to the gas-liquid separator 14. The hydrogen-containing gas separated by the second water recovery unit 26 contains water vapor in addition to unreacted hydrogen gas. The hydrogen-containing gas is supplied to the hydrogen gas supply path 52 via the downstream portion 60_2 of the hydrogen circulation path 60.

The control device 28 is a computer that controls the water electrolysis system 10. The control device 28 includes one or more processors and a storage medium. The storage medium may be constituted by a volatile memory and a non-volatile memory. The processor may be a CPU, an MCU, or the like. As examples of the volatile memory, there may be cited a RAM or the like. As examples of the nonvolatile memory, there may be cited a ROM, a flash memory, or the like.

The control device 28 controls the first power supply device 13 to apply a predetermined voltage to the anode A_12 and the cathode C_12 of the water electrolysis stack 12. In addition, the control device 28 turns on the pump 31 to supply water from the gas-liquid separator 14 to the water electrolysis stack 12. In this case, the water electrolysis stack 12 is in an operating state, and electrolysis of water (water electrolysis) is performed. When the control device 28 stops the application of voltage and the supply of water to the water electrolysis stack 12, the water electrolysis stack 12 enters a non-operating state.

When the water level of the water stored in the gas-liquid separator 14 becomes lower than a predetermined lower limit value, the control device 28 opens at least one of the first feed-water valve 39 or the second feed-water valve 40. Further, the control device 28 turns on the pump 41 to supply water from at least one of the first water recovery unit 24 or the second water recovery unit 26 to the gas-liquid separator 14. When the water level of the water stored in the gas-liquid separator 14 becomes equal to or higher than a predetermined water level threshold value, the control device 28 closes the first feed-water valve 39 and the second feed-water valve 40 and turns off the pump 41. The water stored in the gas-liquid separator 14 is detected by a water level sensor provided in the gas-liquid separator 14.

The control device 28 controls the second power supply device 19 to apply a predetermined voltage to the anode A_18 and the cathode C_18 of the hydrogen pressure boosting stack 18. In addition, the control device 28 turns on the pump 37 to supply the hydrogen gas from the gas-liquid separator 14 to the hydrogen pressure boosting stack 18. In this case, the hydrogen pressure boosting stack 18 is in an operating state, and the pressure of the hydrogen gas is boosted. When the control device 28 stops the application of the voltage and the supply of the hydrogen gas to the hydrogen pressure boosting stack 18, the hydrogen pressure boosting stack 18 is brought into a non-operating state.

The operation of the water electrolysis stack 12 and the operation of the hydrogen pressure boosting stack 18 are performed as a set. That is, when the control device 28 brings the water electrolysis stack 12 into the operating state, the control device 28 also brings the hydrogen pressure boosting stack 18 into the operating state. On the other hand, when the water electrolysis stack 12 is brought into the non-operating state, the control device 28 also brings the hydrogen pressure boosting stack 18 into the non-operating state.

During the operation of the water electrolysis stack 12 and the hydrogen pressure boosting stack 18, the control device 28 closes the oxygen release valve 44 and the hydrogen release valve 54. In this case, the high-pressure oxygen gas generated by the water electrolysis of the water electrolysis stack 12 is stored in the oxygen tank 16, and the high-pressure hydrogen gas pressure-boosted by the hydrogen pressure boosting stack 18 is stored in the hydrogen tank 20. The oxygen gas stored in the oxygen tank 16 and the hydrogen gas stored in the hydrogen tank are not supplied to the fuel cell 22. Therefore, the fuel cell 22 is in a non-operating state and does not generate power.

On the other hand, when the water electrolysis stack 12 and the hydrogen pressure boosting stack 18 are not in operation, the control device 28 opens the oxygen release valve 44 and the hydrogen release valve 54 to bring the fuel cell 22 into an operating state. In this case, the oxygen gas stored in the oxygen tank 16 is supplied to the fuel cell 22 after being reduced in pressure by the pressure reducing valve 46. Further, the hydrogen gas stored in the hydrogen tank 20 is supplied to the fuel cell 22 after being reduced in pressure by the pressure reducing valve 56. The fuel cell 22 generates electricity. During the operation of the fuel cell 22, the control device 28 turns on the pump 59 to supply the oxygen-containing gas discharged from the fuel cell 22, to the fuel cell 22 via the first water recovery unit 24. Further, the control device 28 turns on the pump 61 to supply the hydrogen-containing gas discharged from the fuel cell 22, to the fuel cell 22 via the second water recovery unit 26.

The operation of the water electrolysis stack 12 and the hydrogen pressure boosting stack 18 and the operation of the fuel cell 22 may be alternately performed.

Figure 2:
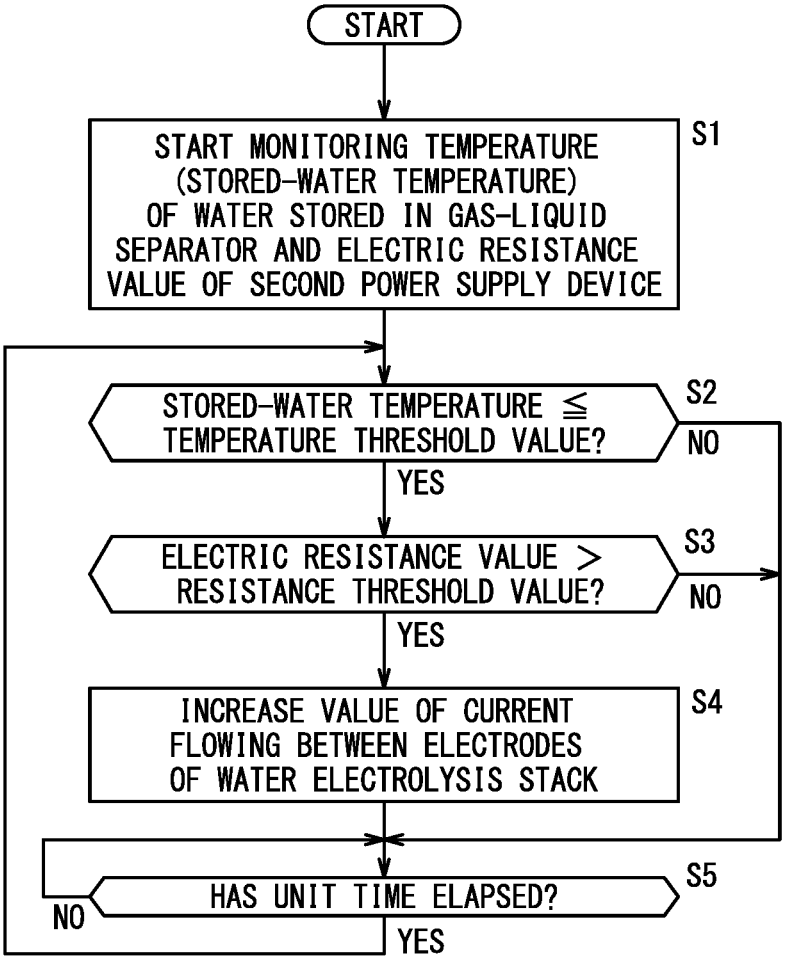
FIG. 2 is a flowchart illustrating a procedure of a temperature adjustment process.

During the operation of the water electrolysis stack 12 and the hydrogen pressure boosting stack 18, the control device 28 executes temperature adjustment process for adjusting the dew point temperature of the gas-liquid separator 14. FIG. 2 is a flowchart illustrating a procedure of a temperature adjustment process.

When the operation of the water electrolysis stack 12 is started, the temperature of the water electrolysis stack 12 rises in accordance with heat or the like generated during the electrolytic reaction of water. The temperature adjustment process proceeds to step S1 when the temperature of the water electrolysis stack 12 exceeds a predetermined temperature threshold value. The temperature of the water electrolysis stack 12 is detected by a temperature sensor provided in the water electrolysis stack 12.

In step S1, the control device 28 starts monitoring the temperature (stored-water temperature) of the water stored in the gas-liquid separator 14. In this case, the control device 28 stores the stored-water temperature of the gas-liquid separator 14 in time series in the storage medium. The stored-water temperature is detected by a temperature sensor 70 (FIG. 1) provided in the gas-liquid separator 14.

Further, the control device 28 starts monitoring the electric resistance value of the second power supply device 19 that applies a predetermined voltage to the anode A_18 and the cathode C_18 of the hydrogen pressure boosting stack 18. In this case, the control device 28 stores the electric resistance value of the second power supply device 19 in time series in the storage medium. The electric resistance value may be a statistical value such as an average of a plurality of unit cells, or may be an electric resistance value of a representative unit cell. The electric resistance value is acquired by calculation from values detected by a voltage sensor 72 and a current sensor 74 provided in the second power supply device 19. When a resistance measuring device is provided in the second power supply device 19, the electric resistance value may be acquired from the resistance measuring device. When the monitoring of the stored-water temperature and the electric resistance value is started, the temperature adjustment process proceeds to step S2.

In step S2, the control device 28 compares the stored-water temperature with the predetermined temperature threshold value stored in the storage medium. When the stored-water temperature is equal to or lower than the temperature threshold value (the stored-water temperature the temperature threshold value), the temperature adjustment process proceeds to step S3. On the other hand, when the stored-water temperature is higher than the temperature threshold value (the stored-water temperature>the temperature threshold value), the temperature adjustment process proceeds to step S5.

In step S3, the control device 28 compares the electric resistance value stored in the storage medium, with a predetermined resistance threshold value. When the electric resistance value is higher than the resistance threshold value (the electric resistance value>the resistance threshold value), the temperature adjustment process proceeds to step S4. On the other hand, when the electric resistance value is equal to or less than the resistance threshold value, the temperature adjustment process proceeds to step S5.

In step S4, the control device 28 controls the first power supply device 13 to increase the current value of the current flowing between the anode A_12 and the cathode C_12 of the water electrolysis stack 12, to be greater than the present value. When the current value is increased, the temperature adjustment process proceeds to step S5.

In step S5, the control device 28 determines whether or not a unit time has elapsed since the completion of the comparison between the electric resistance value and the resistance threshold value. If the unit time has not yet elapsed, the temperature adjustment process remains at step S5. On the other hand, when the unit time has elapsed, the temperature adjustment process returns to step S2.

As described above, in the present embodiment, the electric resistance value of the second power supply device 19 and the stored-water temperature of the gas-liquid separator 14 are used to determine whether or not the electrolyte membrane M_18 of the hydrogen pressure boosting stack 18 is dry.

In general, as the water content of the electrolyte membrane M_18 of the hydrogen pressure boosting stack 18 decreases, the membrane resistance (internal resistance) increases. Therefore, the dry state of the electrolyte membrane M_18 of the hydrogen pressure boosting stack 18 can be determined only from the electric resistance value of the second power supply device 19. However, the electric resistance value of the second power supply device 19 may change due to factors other than the water content of the electrolyte membrane M_18 of the hydrogen pressure boosting stack 18. Therefore, in the present embodiment, the stored-water temperature of the gas-liquid separator 14 is used in addition to the electric resistance value of the second power supply device 19. The stored-water temperature has an extremely high correlation with the amount of water vapor in the hydrogen-containing gas supplied to the hydrogen pressure boosting stack 18. Therefore, it is possible to accurately determine whether or not the electrolyte membrane M_18 of the hydrogen pressure boosting stack 18 is dry based on the electric resistance value of the second power supply device 19 and the stored-water temperature of the gas-liquid separator 14.

When it is determined that the electrolyte membrane M_18 of the hydrogen pressure boosting stack 18 is dry, in the present embodiment, the value of the electric current applied to the water electrolysis stack 12 is increased. In this case, the temperature of the water supplied from the water electrolysis stack 12 to the gas-liquid separator 14 increases due to the heat generation of the water electrolysis stack 12 accompanying the increase in the current value. As a result, the humidity inside the gas-liquid separator 14 increases, and the amount of water vapor supplied from the gas-liquid separator 14 to the hydrogen pressure boosting stack 18 together with the hydrogen gas increases. Therefore, deterioration of the electrolyte membrane M_18 of the hydrogen pressure boosting stack 18 due to drying is suppressed.

As described above, the control device 28 of the present embodiment controls the current value to be applied to the water electrolysis stack 12 based on the electric resistance value of the second power supply device 19 that applies the constant voltage and the stored-water temperature of the gas-liquid separator 14. This makes it possible to accurately determine whether or not the electrolyte membrane M_18 of the hydrogen pressure boosting stack 18 is dry, and to adjust the amount of water vapor in the hydrogen-containing gas supplied from the gas-liquid separator 14 to the hydrogen pressure boosting stack 18. As a result, deterioration of the electrolyte membrane M_18 of the hydrogen pressure boosting stack 18 due to drying can be reduced.

The above-described embodiment may be modified as follows.

Figure 3:
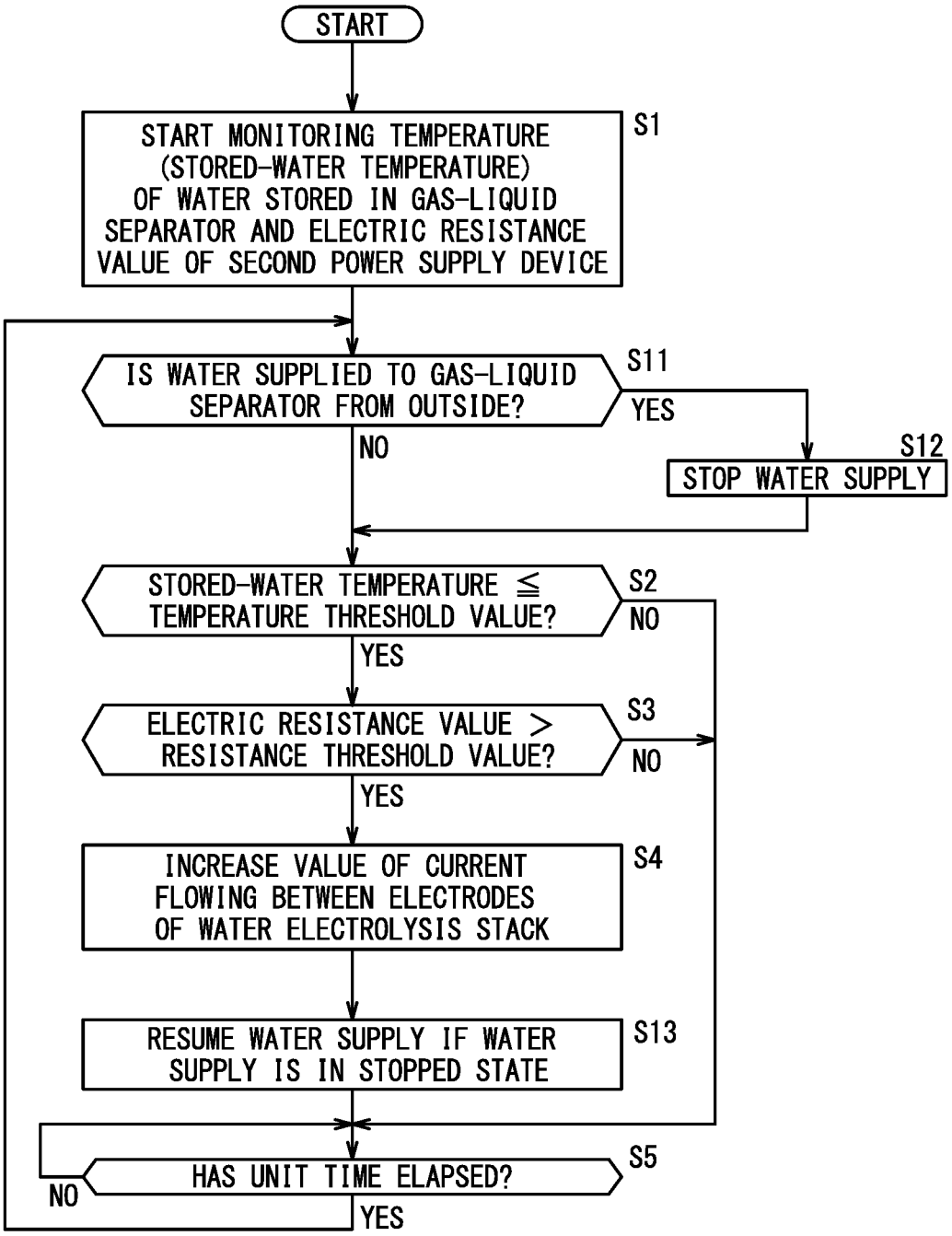
FIG. 3 is a flowchart illustrating a procedure of a temperature adjustment process according to a modification.

FIG. 3 is a flowchart illustrating a procedure of a temperature adjustment process according to a modification. In the present modification, steps S11 to S13 are newly added.

In the present modification, when monitoring of the stored-water temperature and the electric resistance value is started in step S1, the temperature adjustment process proceeds to step S11.

In step S11, the control device 28 determines whether or not water is supplied to the gas-liquid separator 14 from the outside of the gas-liquid separator 14. The outside of the gas-liquid separator 14 includes a first water recovery unit 24 and a second water recovery unit 26. When a water supply unit such as a water supply tank is connected to the gas-liquid separator 14, the water supply unit is also included as the outside of the gas-liquid separator 14. When water is not supplied to the gas-liquid separator 14 from the outside of the gas-liquid separator 14, the temperature adjustment process proceeds to step S2. On the other hand, when water is supplied to the gas-liquid separator 14 from the outside of the gas-liquid separator 14, the temperature adjustment process proceeds to step S12.

In step S12, the control device 28 closes the first and second feed-water valves 39 and 40 provided in the feed-water path 38 communicating with the gas-liquid separator 14 to stop the supply of water to the gas-liquid separator 14. When water is supplied from the water supply unit to the gas-liquid separator 14, the control device 28 controls the water supply unit to stop the water supply. When the water supply to the gas-liquid separator 14 is stopped, the temperature adjustment process proceeds to step S2.

In the present modification, when the current value is increased in step S4, the temperature adjustment process proceeds to step S13.

In step S13, the control device 28 resumes the water supply to the gas-liquid separator 14 only when the water supply to the gas-liquid separator 14 is stopped in step S12. When the supply of water to the gas-liquid separator 14 is resumed, the temperature adjustment process proceeds to step S5. When the water supply to the gas-liquid separator 14 is not stopped in step S12, the control device 28 does not execute any particular processing, and the temperature adjustment process proceeds to step S5.

As described above, in the present modification, the control device 28 stops the supply of water from the outside to the gas-liquid separator 14 during the execution of the control for increasing the value of the current flowing between the electrodes of the water electrolysis stack 12. As a result, the water stored in the gas-liquid separator 14 can be prevented from being cooled by water from the outside. Therefore, the temperature of the water stored in the gas-liquid separator 14 can be rapidly increased based on the heat generation of the water electrolysis stack 12 accompanying the increase in the current value. Therefore, the amount of water vapor supplied from the gas-liquid separator 14 to the hydrogen pressure boosting stack 18 together with the hydrogen gas can be rapidly increased.

A description will be given below concerning an invention and effects that are capable of being grasped from the above-descriptions.

(1) The present invention is characterized by the water electrolysis system (10) including: the water electrolysis stack (12) including the membrane electrode assembly (MEA_12) in which the electrolyte membrane (M_12) is held between the anode (A_12) and the cathode (C_12), the water electrolysis stack being configured to electrolyze water; the gas-liquid separator (14) configured to separate the water and hydrogen gas generated by electrolysis of the water by the water electrolysis stack (12); and the hydrogen pressure boosting stack (18) including the membrane electrode assembly (MEA_18) in which the electrolyte membrane (M_18) is held between the anode (A_18) and the cathode (C_18), the hydrogen pressure boosting stack being configured to boost the pressure of the hydrogen gas separated by the gas-liquid separator (14). The water electrolysis system (10) further includes: the first power supply device (13) configured to apply a voltage to the anode (A_12) and the cathode (C_12) of the water electrolysis stack (12) to cause a current to flow between the anode (A_12) and the cathode (C_12) of the water electrolysis stack (12); the second power supply device (19) configured to apply a voltage to the anode (A_18) and the cathode (C_18) of the hydrogen pressure boosting stack (18) to cause a current to flow between the anode (A_18) and the cathode (C_18) of the hydrogen pressure boosting stack (18); the temperature sensor (70) configured to detect the temperature of the water in the gas-liquid separator (14); and the control device (28) configured to acquire the electric resistance value of the second power supply device (19) that applies a predetermined voltage to the anode (A_18) and the cathode (C_18) of the hydrogen pressure boosting stack (18), and to control the value of the current to be applied to the water electrolysis stack (12), based on the electric resistance value and the temperature.

This makes it possible to accurately determine whether or not the electrolyte membrane of the hydrogen pressure boosting stack is dry, and to adjust the amount of water vapor supplied from the gas-liquid separator to the hydrogen pressure boosting stack together with the hydrogen gas. As a result, deterioration of the electrolyte membrane of the hydrogen pressure boosting stack due to drying can be reduced.

(2) In the water electrolysis system (10) of the present invention, when the electric resistance value is higher than a predetermined resistance threshold value and the temperature is equal to or lower than a predetermined temperature threshold value, the control device (28) may increase the value of the current. This makes it possible to accurately determine the dry state of the electrolyte membrane of the hydrogen pressure boosting stack and increase the amount of water vapor supplied from the gas-liquid separator to the hydrogen pressure boosting stack together with the hydrogen gas.

(3) In the water electrolysis system (10) of the present invention, the gas-liquid separator (14) may be a supply source of the water to be supplied to the water electrolysis stack (12), and during execution of control for increasing the value of the current, the control device (28) may stop supply of water from the outside to the gas-liquid separator (14). As a result, the water stored in the gas-liquid separator can be prevented from being cooled by water from the outside. Therefore, the temperature of the water stored in the gas-liquid separator can be rapidly increased based on the heat generation of the water electrolysis stack accompanying the increase in the current value. Therefore, the amount of water vapor supplied from the gas-liquid separator to the hydrogen pressure boosting stack together with the hydrogen gas can be rapidly increased.

Moreover, the present invention is not limited to the above-described disclosure, and various configurations can be adopted therein without departing from the essence and gist of the present invention.

The invention claimed is:

1. A water electrolysis system comprising:

a water electrolysis stack including a membrane electrode assembly in which an electrolyte membrane is held between an anode and a cathode, the water electrolysis stack being configured to electrolyze water;

a gas-liquid separator configured to separate the water and hydrogen gas generated by electrolysis of the water by the water electrolysis stack; and a hydrogen pressure boosting stack including a membrane electrode assembly in which an electrolyte membrane is held between an anode and a cathode, the hydrogen pressure boosting stack being configured to boost a pressure of the hydrogen gas separated by the gas-liquid separator, wherein the water electrolysis system further comprises:

a first power supply device configured to apply a voltage to the anode and the cathode of the water electrolysis stack to cause a current to flow between the anode and the cathode of the water electrolysis stack;

a second power supply device configured to apply a voltage to the anode and the cathode of the hydrogen pressure boosting stack to cause a current to flow between the anode and the cathode of the hydrogen pressure boosting stack;

a temperature sensor configured to detect a temperature of the water in the gas-liquid separator; and a control device configured to acquire an electric resistance value of the second power supply device that applies a predetermined voltage to the anode and the cathode of the hydrogen pressure boosting stack, and to control a value of a current to be applied to the water electrolysis stack, based on the electric resistance value and the temperature.

2. The water electrolysis system according to claim 1, wherein when the electric resistance value is higher than a predetermined resistance threshold value and the temperature is equal to or lower than a predetermined temperature threshold value, the control device increases the value of the current.

3. The water electrolysis system according to claim 2, wherein the gas-liquid separator is a supply source of the water to be supplied to the water electrolysis stack, and during execution of control for increasing the value of the current, the control device stops supply of water from an outside of the gas-liquid separator to the gas-liquid separator.

* * * * *